US011655077B2

(12) United States Patent
Nathan

(10) Patent No.: US 11,655,077 B2
(45) **Date of Patent: *May 23, 2023**

(54) SQUEEZABLE DISPENSING PACKAGE AND METHOD

(71) Applicant: MaxPax LLC, Walworth, WI (US)

(72) Inventor: Bill Nathan, Whitewater, WI (US)

(73) Assignee: MaxPax LLC, Walworth, WI (US)

( * ) Notice: Subject to any disclaimer, the term of this patent is extended or adjusted under 35 U.S.C. 154(b) by 360 days.

This patent is subject to a terminal disclaimer.

(21) Appl. No.: 16/896,841

(22) Filed: Jun. 9, 2020

(65) Prior Publication Data

US 2020/0299034 A1 Sep. 24, 2020

Related U.S. Application Data

(60) Continuation of application No. 15/793,689, filed on Oct. 25, 2017, now Pat. No. 10,710,776, which is a (Continued)

(51) Int. Cl.
*B65D 35/14* (2006.01)
*B65D 75/58* (2006.01)
(Continued)

(52) U.S. Cl.
CPC ..... *B65D 35/14* (2013.01); *B65B 3/02* (2013.01); *B65B 11/48* (2013.01); *B65B 69/005* (2013.01);
(Continued)

(58) Field of Classification Search
CPC ..... B65D 75/5811; B65D 47/10; B65D 81/3272; B65D 81/3266; B65D 2221/00; B65D 35/22; B65D 35/14
See application file for complete search history.

(56) References Cited

U.S. PATENT DOCUMENTS 2,916,197 A 12/1959 Detrie et al.
3,294,227 A 12/1966 Schneider et al.
(Continued)

FOREIGN PATENT DOCUMENTS

JP 2001122360 5/2001

OTHER PUBLICATIONS

European Search Report for European Patent Application No. 13 86 6198, dated May 23, 2016, 6 pages.
(Continued)

*Primary Examiner* — Patrick M. Buechner
(74) *Attorney, Agent, or Firm* — Reinhart Boerner Van Deuren s.c.

(57) ABSTRACT

A fluid dispensing container is provided. The container includes a container body formed from a first flexible material defining an interior cavity. The container includes a membrane formed from a second flexible material and a seal coupling the membrane to the inner surface of the container body. The membrane divides the interior cavity into a contents chamber and a dispensing chamber, and the membrane and the seal are configured to be fluid tight to maintain fluid within the contents chamber prior to rupture of the membrane. The rupture stress of the second flexible material is less than the rupture stress of the first flexible material such that, as fluid pressure within the contents chamber increases, the membrane is configured to rupture without the container body rupturing.

20 Claims, 6 Drawing Sheets

Related U.S. Application Data continuation of application No. 14/285,293, filed on May 22, 2014, now Pat. No. 9,828,143, which is a division of application No. 13/725,465, filed on Dec. 21, 2012, now Pat. No. 9,586,727.

(51) Int. Cl.
*B65B 11/48* (2006.01)
*B65B 69/00* (2006.01)
*B65B 3/02* (2006.01)

(52) U.S. Cl.
CPC ..... *B65D 75/5811* (2013.01); *B65D 2221/00* (2013.01)

(56) References Cited

U.S. PATENT DOCUMENTS 3,913,789 A 10/1975 Miller
4,458,811 A 7/1984 Wilkinson
4,519,499 A 5/1985 Stone et al.
4,526,823 A 7/1985 Farrell et al.
4,540,089 A 9/1985 Maloney
4,557,377 A 12/1985 Maloney
4,641,362 A 2/1987 Muller
4,759,472 A 7/1988 Strenger
4,830,205 A 5/1989 Hammond et al.
4,872,556 A 10/1989 Farmer
4,890,744 A 1/1990 Lane, Jr. et al.
4,898,477 A 2/1990 Cox et al.
4,921,137 A 5/1990 Heijenga
5,131,760 A 7/1992 Farmer
5,169,030 A * 12/1992 Lewin ..... B65D 35/22 222/107
5,195,658 A 3/1993 Hoshino
5,373,966 A 12/1994 O'Reilly et al.
5,458,244 A 10/1995 Emori
5,560,403 A 10/1996 Balteau et al.
5,632,416 A 5/1997 Lane, Jr. et al.
5,832,698 A 11/1998 Huguenin
5,882,789 A 3/1999 Jones et al.
6,193,058 B1 2/2001 Yacko et al.
6,620,436 B1 9/2003 Rolf
6,935,783 B2 8/2005 Carter
7,004,354 B2 2/2006 Harper
7,055,683 B2 6/2006 Bourque et al.
7,458,741 B2 12/2008 Detwiler et al.
7,866,886 B2 1/2011 Kurosawa
8,376,183 B1 * 2/2013 Rosen ..... B65D 81/3266 222/106
9,586,727 B2 3/2017 Nathan
10,011,399 B1 * 7/2018 Adell ..... B65D 81/3266
2002/0017310 A1 2/2002 Gruenbacher et al.
2004/0155059 A1 8/2004 Harper
2004/0223801 A1 11/2004 Detwiler
2005/0025394 A1 2/2005 Kinigakis et al.
2006/0196784 A1 9/2006 Murray
2007/0119862 A1 5/2007 Backes et al.
2008/0083348 A1 4/2008 Kuo et al.
2008/0177243 A1 7/2008 Roger
2008/0276645 A1 11/2008 Murray
2010/0304062 A1 12/2010 Daviknes et al.
2013/0264356 A1 * 10/2013 Chen ..... B65D 35/14 222/92
2014/0250838 A1 9/2014 Nathan

OTHER PUBLICATIONS

International Search Report and Written Opinion for International Application No. PCT/US2013/041078, dated Sep. 4, 2013, 9 pages.
David Roylance, Pressure Vessels, Aug. 23, 2001, MIT Dept of Material Science and Engineering. Retrieved on Feb. 20, 2017 from URL https://ocw.mit.edu/courses/materials-science-and-engineering/3-11 -mechanics-of-materials-fall-1999/modules/MIT3_11 F99_pv.pdf.

* cited by examiner

SQUEEZABLE DISPENSING PACKAGE AND METHOD

CROSS-REFERENCE TO RELATED PATENT APPLICATION

This application is a continuation of U.S. patent application Ser. No. 15/793,689, filed Oct. 25, 2017, which is a continuation of U.S. patent application Ser. No. 14/285,293, filed May 22, 2014, now U.S. Pat. No. 9,828,143, which is a divisional of U.S. patent application Ser. No. 13/725,465, now U.S. Pat. No. 9,586,727, filed Dec. 21, 2012, each of which are incorporated herein by reference in their entireties and the priority of each of which is hereby claimed.

BACKGROUND OF THE INVENTION

The present invention relates generally to the field of containers. The present invention relates specifically to a container with a rupturable inner membrane.

SUMMARY OF THE INVENTION

One embodiment of the invention relates to a heat-sealed squeezable dispensing pouch. The pouch includes an outer sheet having a front wall, a rear wall and a folded edge located between the front wall and the rear wall. The outer sheet is folded along the folded edge such that an inner surface of the front wall faces an inner surface of the rear wall. The pouch includes a first heat seal coupling the inner surface of a peripheral section of the front wall to a peripheral section of the inner surface of the rear wall such that the inner surfaces of the front and rear walls define an interior chamber. The pouch includes a rupturable inner membrane formed from a contiguous, single monolayer of thermoplastic material, and the rupturable inner membrane is located within the interior chamber. The rupturable inner membrane divides the interior chamber into a contents compartment and a dispensing channel. The first heat seal defines an edge of the contents compartment and the folded edge defines an edge of the dispensing channel. A second heat seal couples the rupturable inner membrane to the inner surface of the front wall, and a third heat seal couples the rupturable inner membrane to the inner surface of the rear wall. A score line formed in both the front and rear walls located between the folded edge and the rupturable inner membrane, and the score line is configured such that the portion of the outer sheet between the score line and the folded edge can be removed to create a dispensing opening in the dispensing channel. The rupturable inner membrane is configured to break when the pressure within the contents compartment is greater than a rupture threshold, and the first, second and third heat seals are configured to remain sealed when the inner membrane breaks.

Another embodiment of the invention relates to a fluid dispensing container. The container includes a container body formed from a first flexible material, and the container body includes an outer surface, an inner surface, a filling end and a dispensing end. The inner surface of the container body defines an interior cavity. The container includes a membrane formed from a second flexible material and a seal coupling the membrane to the inner surface of the container body at a position located between the filling end and the dispensing end. The membrane divides the interior cavity into a contents chamber and a dispensing chamber, and the membrane and the seal are configured to be fluid tight to maintain fluid within the contents chamber prior to rupture of the membrane. The rupture stress of the second flexible material is less than the rupture stress of the first flexible material such that, as fluid pressure within the contents chamber increases, the membrane is configured to rupture without the container body rupturing.

Another embodiment of the invention relates to a method of forming a container. The method includes the step of providing a first sheet of first flexible material and a second sheet of second flexible material. The method includes the step of folding the first sheet creating a folded edge that divides the first sheet into a front wall and a rear wall. The front wall and the rear wall each have an upper edge opposite the folded edge. The method includes the step of positioning the second sheet between the front wall and the rear wall of the folded first sheet. The method includes the step of creating a first heat seal attaching a front surface of the second sheet to an inner surface of the front wall of the first sheet. The method includes the step of creating a second heat seal attaching a rear surface of the second sheet to an inner surface of the rear wall of the first sheet and the step of creating a third heat seal attaching a left side of the front wall to a left side of the rear wall to seal the left side of the container. The method includes the step of creating a fourth heat seal attaching a right side of the front wall to a right side of the rear wall to seal the right side of the container. The method includes the step of filling the container through a filling opening defined by the upper edges of the front and rear walls of the first sheet. The method includes the step of creating a fifth heat seal attaching the upper edge of the front wall to the upper edge of the rear wall sealing the filling opening.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of a dispensing container are shown. Generally the various embodiments of the container include an outer container body or sidewall and an internal wall or membrane that is located within the container body. The membrane separates the interior cavity of the container into two portions or subsections, a contents compartment and a dispensing passage. Container contents, for example, fluid or liquid contents are stored within the contents compartment prior to use of the container. When the container is to be opened, the user creates an opening in the portion of the container body defining the dispensing passage. At this point, the fluid contents of the container are maintained within the contents chamber by the membrane. To dispense the fluid, pressure within the contents chamber is increased, for example by squeezing the portion of the outer container body over the contents chamber. When the pressure reaches the rupture stress of the membrane, the membrane ruptures allowing the contents of the container to flow from the contents chamber into the dispensing passage and out through the opening. The material of the membrane is selected to be weaker than the material of the outer container body and weaker than the attachment points of the membrane such that the membrane will rupture while the outer container body and attachment points (e.g., heat seals) remain intact, providing for controlled dispensing of fluids from the container.

Figure 1:
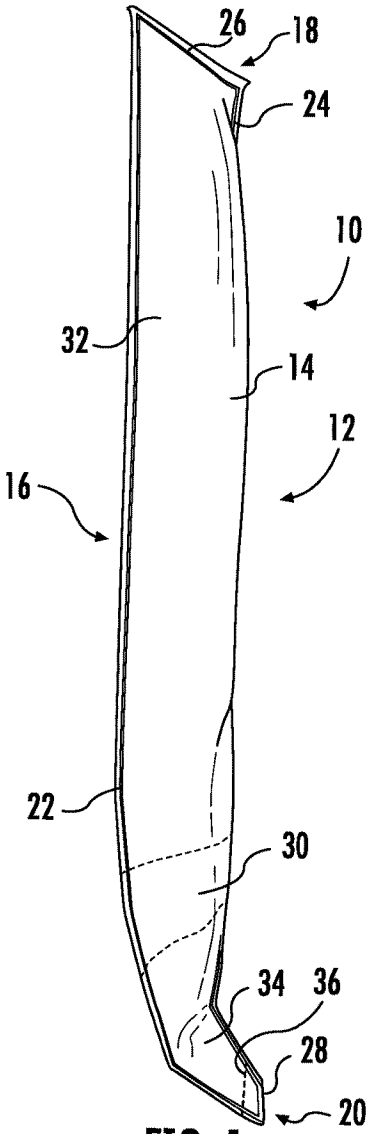
FIG. 1 is a perspective view of a dispensing pouch according to an exemplary embodiment.

Referring to FIG. 1, a dispensing container, shown as fluid dispensing pouch 10, is depicted according to an exemplary embodiment. Dispensing pouch 10 includes a container body, shown as body 12. Generally, body 12 includes a front portion or wall 14 and a rear portion or wall 16 opposite front wall 14. Pouch 10 includes a filling end, shown as upper end 18, and a dispensing end, shown as lower end 20. As explained in more detail below, upper end 18 is open prior to being sealed allowing pouch 10 to be filled, and lower end 20 is opened by the user such that fluid may be dispensed from pouch 10 at the time of use.

In the embodiment shown, body 12 is formed from a flexible material such that pouch 10 is a flexible or squeezable container. In this embodiment, front wall 14 is attached to rear wall 16 by one or more seals or attachments formed between the peripheral sections of front wall 14 and the opposing peripheral sections of rear wall 16. Specifically, pouch 10 includes a left lateral heat seal 22, a right lateral heat seal 24 and an upper heat seal 26. Left lateral heat seal 22 couples the left lateral edge of front wall 14 to the left lateral edge of rear wall 16. Right lateral heat seal 24 couples the right lateral edge of front wall 14 to the right lateral edge of rear wall 16. Upper heat seal 26 couples the upper edge of front wall 14 to the upper edge of rear wall 16. Thus, as shown, left lateral heat seal 22 defines the left lateral edge of pouch 10, right lateral heat seal 24 defines the right lateral edge of pouch 10, and upper heat seal 26 defines the upper edge of pouch 10. As shown in more detail below, upper heat seal 26 is formed following filling of the container through an open upper end.

In one embodiment, heat seals 22, 24 and 26 are seals formed by melting together an adhesive layer located on the inner surfaces of front wall 14 and/or rear wall 16. In one embodiment, heat seals 22, 24 and 26 are formed by melting together a thermoplastic material. In other embodiments, other types of seals may be used. In one embodiment, seals 22, 24 and 26 may be formed by ultrasonic welding, and in another embodiment, seals 22, 24 and 26 may be formed from a pressure sensitive adhesive.

In the embodiment shown, body 12 of pouch 10 is formed from a folded, single contiguous sheet of flexible material. In this embodiment, pouch 10 includes a folded edge 28, shown located at lower end 20. Front wall 14 and rear wall 16 are located on opposite sides of folded edge 28, and the material of body 12 is folded along folded edge 28 such that the inner surfaces front wall 14 and rear wall 16 face each other and may be coupled together. In another embodiment, front wall 14 and rear wall 16 are formed from separate sheets of material, and in this embodiment, lower end 20 includes a seal (e.g., a heat seal, weld, etc.) closing the bottom edge of the pouch in place of folded edge 28.

Pouch 10 includes a membrane 30 (the upper and lower edges of membrane 30 are depicted by the dotted lines in FIG. 1), and membrane 30 extends between the inner surfaces of front wall 14 and rear wall 16. Pouch 10 includes a contents holding portion 32 located above membrane 30 and a dispensing spout 34 located below membrane 30. As explained in more detail below, portion 32 includes an inner cavity or chamber above membrane 30 that holds the contents of the container prior to rupture of membrane 30, and membrane 30 is a continuous single portion of material that holds the container contents within the contents chamber of pouch 10 prior to rupture of the membrane.

Dispensing spout 34 is located below membrane 30 and extends generally from membrane 30 to folded edge 28. Dispensing spout 34 generally defines a dispensing passage that provides a pathway for fluid to flow out of pouch 10 following rupture of membrane 30 and creation of an opening or aperture in spout 34. In this embodiment, because folded edge 28 provides for a continuous portion of material, folded edge 28 acts as a seal along the distal end of spout 34. In one embodiment, spout 34 includes a frangible tear line 36 located adjacent to folded edge 28 (e.g., tear line is located closer to folded edge 28 than membrane 30). Tear line 36 provides a weakened area to facilitate the removal of the portion of spout 34 between tear line 36 and folded edge 28 to create the opening in spout 34.

Figure 2:
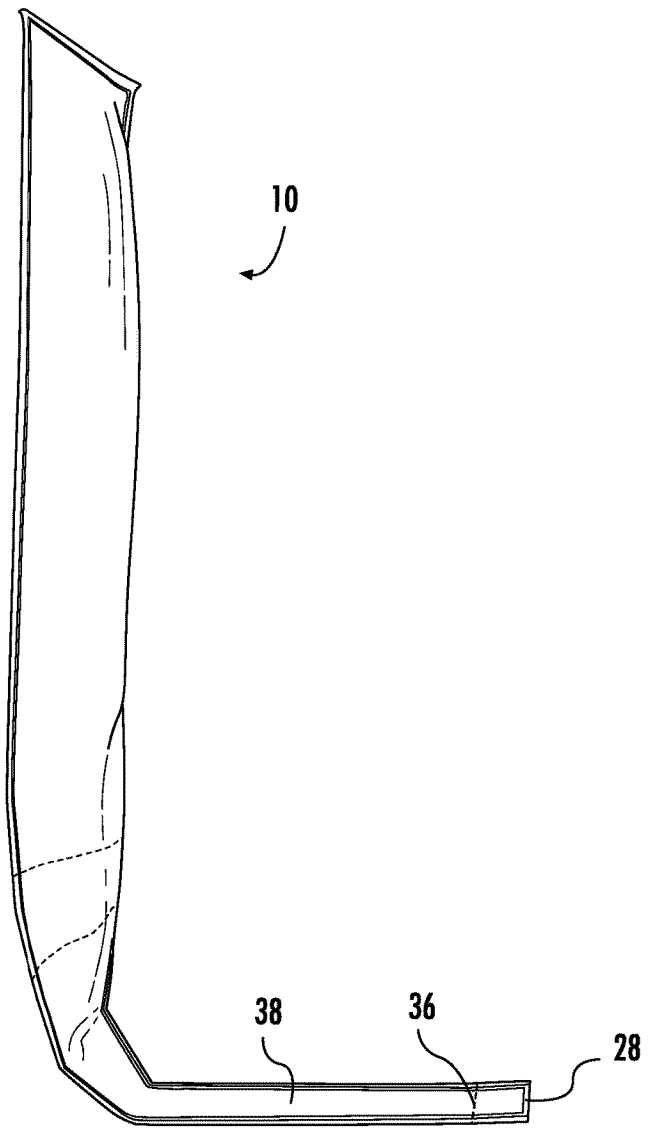
FIG. 2 is a perspective view of a dispensing pouch including an extended spout according to an exemplary embodiment.

Referring to FIG. 2, in another embodiment, pouch 10 may include an elongated dispensing spout 38. Spout 38 is configured to facilitate dispensing of fluid into certain containers that may be difficult to fill using a shortened spout 34. For example, spout 38 may be placed into a container having a small filling opening (e.g., a motor oil filler oil, the opening of refillable spray bottle, etc.) allowing the fluid from pouch 10 to be filled directly into the container without the need for a funnel or other filling device. Spout 38 may be different lengths and widths to suit different applications. In one embodiment, the length of spout 38 (e.g., the distance between membrane 30 and folded edge 28, the distance between membrane 30 and tear line 36) may be greater than 30% of the total length of pouch 10, and in another embodiment, the length of spout 38 may be greater than 50% of the total length of pouch 10. In another embodiment, the length of spout 38 may be between 25% and 75% of the total length of pouch 10. Similarly, the width of spout 38 may be narrower that the width of the pouch 10 at upper heat seal 26. This configuration provides a spout which is more useable for small openings without limiting the width of the pouch 10 at the contents holding position and thus provides a narrow spout without limiting the corresponding volume of pouch 10. In one embodiment, the width of spout 38 is less than 50% of the width of pouch 10 at upper heat seal 26, and in another embodiment, the width of spout 38 is less than 30% of the width of pouch 10 at upper heat seal 26.

Figure 3:
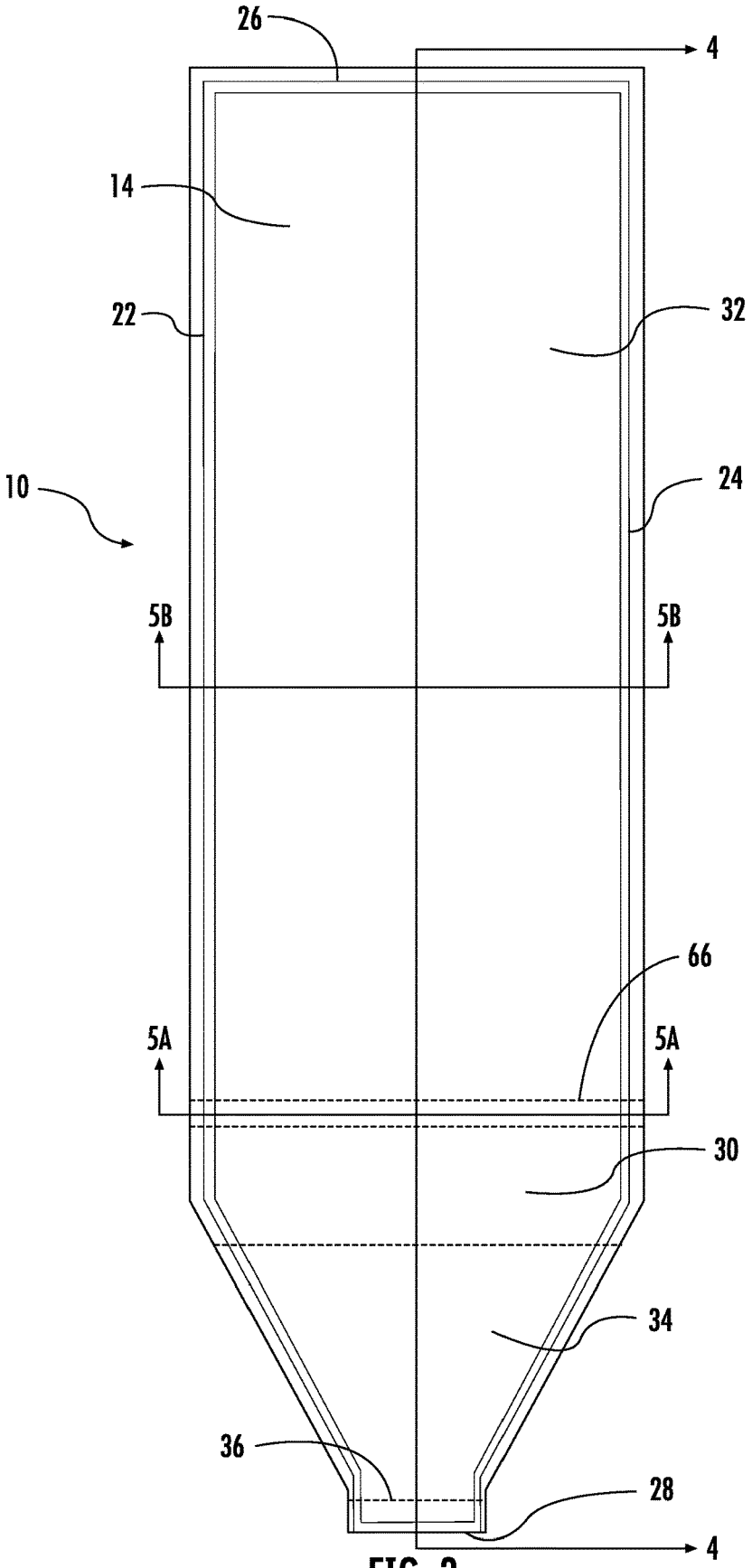
FIG. 3 is a side elevation view of the dispensing pouch of FIG. 1 according to an exemplary embodiment.

Referring to FIG. 3, a side elevation view of pouch 10 is shown according to an exemplary embodiment. In the embodiment shown, the peripheral edge of the portion of pouch 10 between membrane 30 and the upper edge at upper heat seal 26 is a substantially rectangular section. Dispensing spout 34 includes a tapered section that tapers inward toward the longitudinal axis of pouch 10 as the dispensing spout 34 extends towards folded edge 28 and away from upper heat seal 26. In other embodiments, pouch 10 may be formed such that its peripheral edge has other shapes, for example, triangles, squares, circles, ovals, etc.

Figure 4:
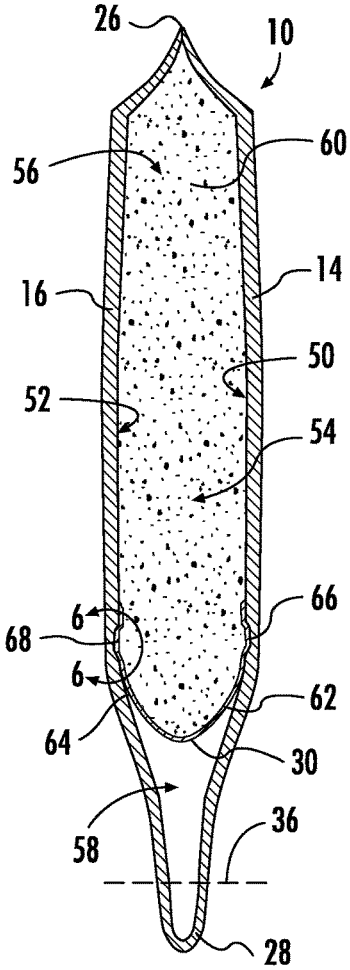
FIG. 4 is a cross-sectional view of the pouch of FIG. 1 taken along line 4-4 shown in FIG. 3 according to an exemplary embodiment.

Referring to FIG. 4, a cross-section view of pouch 10 taken along line 4-4 in FIG. 3, is shown according to an exemplary embodiment. Front wall 14 includes an inner surface 50, and rear wall 16 includes an inner surface 52. Inner surface 50 and inner surface 52 define the interior cavity 54. Membrane 30 separates interior cavity 54 into a contents chamber 56 and a dispensing passage 58. In the embodiment shown, liquid contents 60 are located in contents chamber 56, and membrane 30 provides a barrier maintaining contents 60 within contents chamber 56 prior to the rupture of membrane 30.

As shown in FIG. 4, when viewed perpendicular to the longitudinal axis of pouch 10, membrane 30 is substantially U-shaped having a front wall 62 and rear wall 64. A front heat seal 66 attaches the front surface of membrane front wall 62 to inner surface 50 of body front wall 14, and a rear heat seal 68 attaches a rear surface of membrane rear wall 64 to inner surface 52 of body rear wall 16. Front heat seal 66 and rear heat seal 68 extend the width of pouch 10 between lateral heat seals 22 and 24, as shown by the dotted line representation of front heat seal 66 shown in FIG. 3. The material of membrane 30, front heat seal 66 and rear heat seal 68 are fluid tight such that liquid contents 60 are maintained in contents chamber 56. While seals 66 and 68 are shown in the exemplary embodiments as heat seals, other sealing and attachment arrangements may be used between membrane 30 and outer body 12. For example, pressure sensitive adhesive or ultrasonic welds may be used to provide fluid tight seal and attachment between membrane 30 and the inner surface of body 12.

Liquid contents 60 may be a wide variety of materials that are suitable to be contained within a dispensing pouch such as pouch 10. For example, in one embodiment, liquid contents 60 is a single use amount of a ready to use liquid. In one embodiment, liquid contents 60 may be a ready to use cleaning solution, stain remover, a personal care product (e.g., shampoo, hand lotion, antibacterial lotion, hand soap, etc.), automotive fluid (e.g., motor oil, coolant, gasoline additive, windshield washer fluid, etc.), etc. In another embodiment, liquid contents 60 is a single use amount of a concentrate solution. In various embodiments, the concentrate may be a cleaning concentrate or a drink concentrate. In other embodiments, liquid contents 60 may be any other suitable concentrate material, for example, pesticide concentrates, herbicide concentrates, fertilizer concentrates, automotive fluid concentrates, pharmaceutical concentrates, medical solution concentrates, nutritional supplement concentrates, etc. In these embodiments, the user will dispense the concentrate from pouch 10 into a suitable container, and will add a the proper amount of diluting agent (e.g., water, saline, etc.) to prepare a mixture at the desired concentration level. In one embodiment, pouch 10 is a small size for easy carrying in a bag or pocket.

Figure 5A:
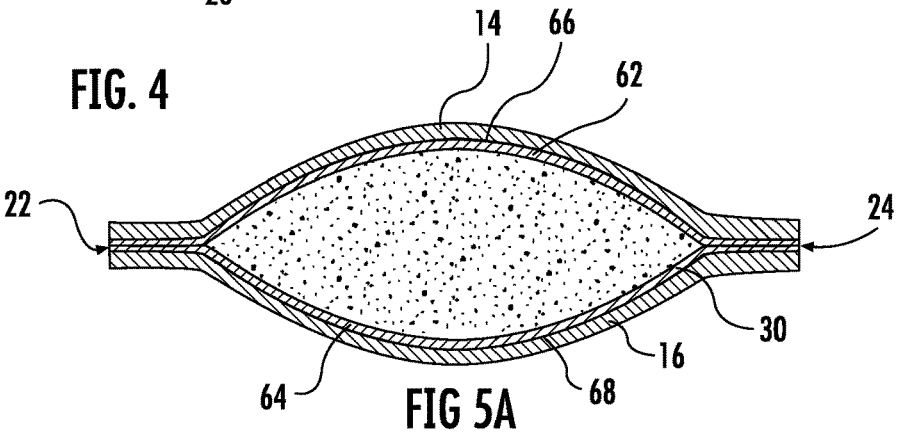
FIG. 5A is a cross-sectional view of the pouch of FIG. 1 taken along line 5A-5A shown in FIG. 3 according to an exemplary embodiment.

Referring to FIG. 5A, a cross-sectional view of pouch 10 taken along line 5A-5A in FIG. 3, is shown according to an exemplary embodiment. While front heat seal 66 and rear heat seal 68 provide for the fluid tight bond that extends laterally along the inner surface of body 12 across the width of pouch 10, a fluid tight seal between membrane 30 and body 12 is also provided along the left and right lateral edge of pouch 10. In the embodiment shown in FIG. 5A, the left and right lateral portions of membrane 30 are positioned between front wall 14 and rear wall 16 of body 12 within the left and right lateral heat seals 22 and 24. Thus, at the position of membrane 30 within the lateral heat seals 22 and 24, the inner surface 50 of body front wall 14 is attached to the outer surface of membrane front wall 62, the inner surface of membrane front wall 62 is attached to the inner surface of membrane rear wall 64, and the outer surface of membrane rear wall 64 is attached to the inner surface 52 of body rear wall 16.

Figure 5B:
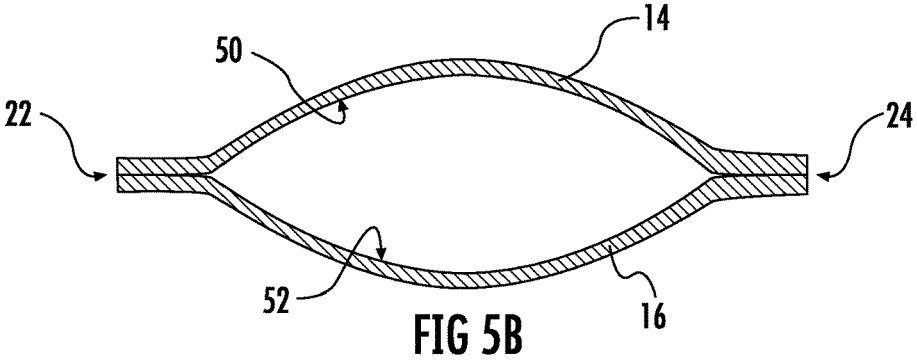
FIG. 5B is a cross-sectional view of the pouch of FIG. 1 taken along line 5B-5B shown in FIG. 3 according to an exemplary embodiment.

Referring to FIG. 5B, a cross-sectional view of pouch 10 taken along line 5B-5B in FIG. 3, is shown according to an exemplary embodiment. FIG. 5B shows left lateral heat seal 22 and right lateral heat seal 24 at an exemplary position that does not include membrane 30. In this embodiment, the inner surface 50 of body front wall 14 is attached to inner surface 52 of body rear wall 16 within heat seals 22 and 24. The upper heat seal 26 shown in FIG. 4 is also formed from an attachment between the inner surface 50 and inner surface 526.

Figure 6:
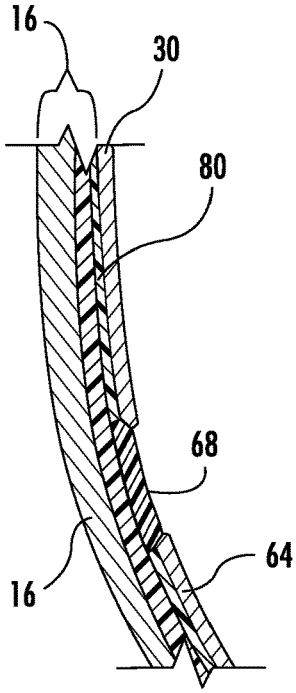
FIG. 6 is a detailed view of a portion of FIG. 4 depicting a heat seal according to an exemplary embodiment.

Referring to FIG. 6, a detailed view of rear wall 16 and membrane 30 at rear heat seal 68 is shown according to an exemplary embodiment. In the embodiment shown, container body 12 and thus, rear body wall 16 is made from a sheet of multilayer material and membrane 30 is made from a single layer or monolayer material. In one such embodiment, the material of container body 12 includes an inner adhesive layer 80. Inner adhesive layer 80 bonds to the material of membrane 30 to form heat seals 66 and 68 and to provide the sealing within the portions of lateral heat seals 22 and 24 shown in FIG. 5A. Inner adhesive layer 80 also bonds with itself to form lateral heat seals 22 and 24 and upper heat seal 26 in those places without membrane 30 (see FIG. 5B).

In one embodiment, the material of the outer container body 12 is formed from a multilayer supported film material. In one such embodiment, the inner adhesive layer 80 is a heat sensitive adhesive, for example a thermoplastic, and at least one of the other outer layers is a strengthened supporting material. In one embodiment, at least one of the outer layers is a foil material, and in another embodiment, at least one of the outer layers is a nylon material. In one such embodiment, membrane 30 is made from a sheet of polymer monolayer material that bonds with the heat sensitive adhesive. For example, in one embodiment, membrane 30 is made from a thermoplastic material that melts to form a fluid tight seal with the thermoplastic of inner adhesive layer. In one embodiment, inner adhesive layer 80 and membrane 30 are made from the same thermoplastic material. For example, inner adhesive layer 80 and membrane 30 may both be a polyethylene material. In other embodiments, inner adhesive layer 80 and membrane 30 are other suitable thermoplastic materials such as polypropylene, polyvinylchloride, etc.

Figure 7A:
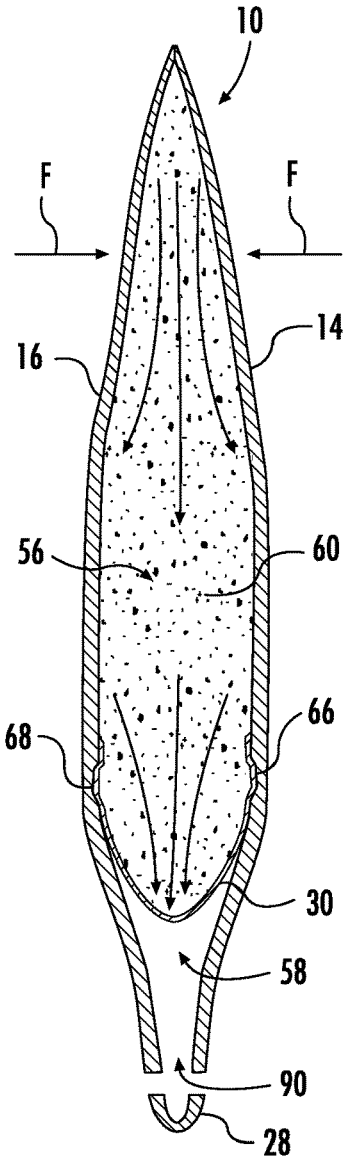
FIG. 7A is a cross-sectional view of a dispensing pouch following opening of the dispensing passage according to an exemplary embodiment.
Figure 7B:
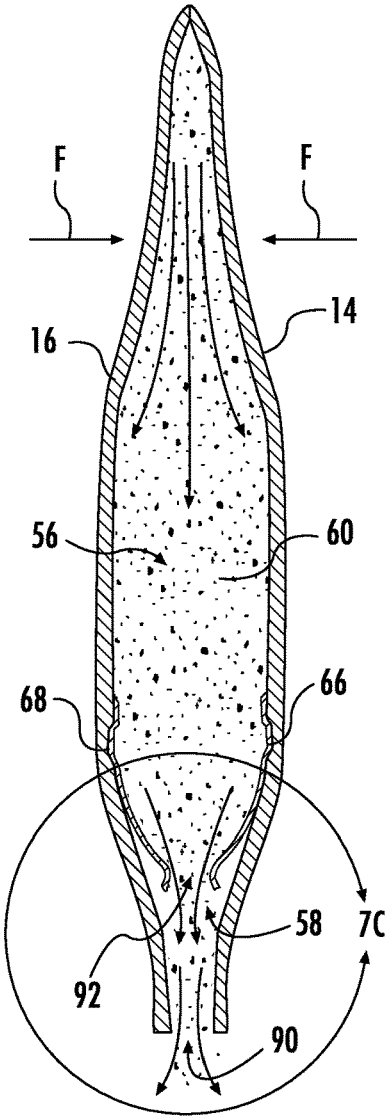
FIG. 7B is a cross-sectional view of a dispensing pouch following rupture of the internal membrane according to an exemplary embodiment.
Figure 7C:
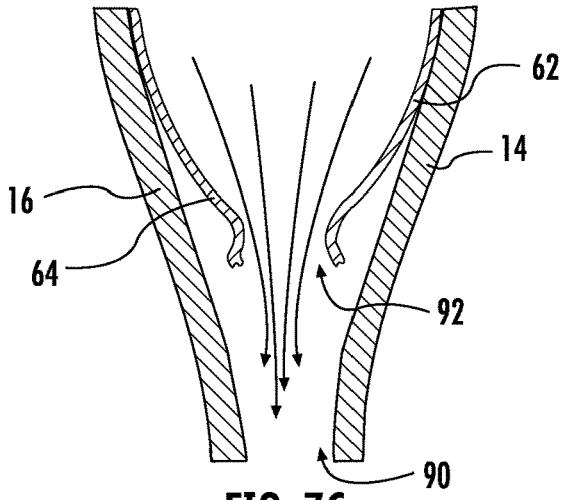
FIG. 7C is a detailed view of a portion of the dispensing pouch of FIG. 7B showing rupture of the internal membrane according to an exemplary embodiment.

Referring to FIGS. 7A-7C, dispensing of contents from container 10 is shown according to an exemplary embodiment. Referring to FIG. 7A, a dispensing opening 90 is created along dispensing passage 58. In the embodiment shown, dispensing opening 90 is created by tearing folded edge 28 along tear line 36 to remove folded edge 28 from body 12. In other embodiments, dispensing opening 90 may be created in other ways. For example, in one embodiment, body 12 does not include tear line 36 and dispensing opening 90 may be created by cutting folded edge 28 from body 12. In another embodiment, dispensing opening 90 may be a preformed opening closed by a closure, for example, a peelable foil closure that is removed prior to dispensing. The sealed end of dispensing passage 58 provided by folded edge 28 (or one of the other sealing mechanisms) provides a backup seal that maintains the contents of pouch 10 with container body 12, even if membrane 30 were to rupture inadvertently prior to intended use. Thus, folded edge 28 may act to limit the chance of spilling if membrane 30 were to be ruptured unintentionally.

After dispensing opening 90 is formed, membrane 30 is ruptured to release contents 60 from contents chamber 56 into passage 58 to allow for contents 60 to be dispensed through opening 90. To rupture membrane 30, pressure within contents chamber 56 is increased such that the pressure is greater than a rupture threshold of membrane 30. As shown in FIG. 7A, the flexible material of body 12 allows an inwardly directed force F to be applied to the outer surfaces of front wall 14 and rear wall 16 resulting in an increase in pressure within contents chamber 56. In one embodiment, pouch 10 is sized to fit within the user's hand or between the user's fingers such that force F is representative of the user squeezing pouch 10. As shown in FIG. 7B and 7C, when the pressure within contents chamber 56 exceeds the rupture threshold of membrane 30, membrane 30 ruptures or breaks at a position between heat seals 66 and 68 to create a membrane breach 92. When membrane 30 ruptures, bonds within the material of membrane 30 break or separate from itself resulting in the creation of the dispensing opening. When membrane 30 ruptures, contents chamber 56 is placed in fluid communication with dispensing passage 58, allowing contents 60 to flow from contents chamber 56, through membrane breach 92 into dispensing passage 58 and then through dispensing opening 90.

In various embodiments, the materials of body 12 and membrane 30 and the structure of the heat seals of pouch 10 are selected such that membrane 30 is the portion of pouch 10 that ruptures or fails upon the increase of pressure within contents chamber 56. In one such embodiment, the material of body 12 is stronger than the material of membrane 30 such that when the rupture threshold of membrane 30 is reached, membrane 30 ruptures but body 12 remains intact. Further, the heat seals 22, 24, 26, 66 and 68 are structured to remain sealed when the rupture threshold of membrane 30 is reached. These configurations help to provide for controlled dispensing by ensuring that membrane 30 breaks while the heat seals and the outer body of pouch 10 remain intact. In various embodiments, the melt temperature used to make a seal relates to the strength of seal. Accordingly, in various embodiments, the melt temperature used to form heat seals 66 and 68 is substantially the same as or similar to the melt temperature used to make heat seals 22, 24, and 26. Using as substantially similar melt temperature for all of the heat seals of pouch 10 helps to ensure that none of the heat seals are weaker than the other heat seals, and thus, helps to ensure that membrane 30 is the portion that ruptures upon increase in pressure. In one embodiment, the melt temperature used to make the heat seals is between 275 and 350 degrees Fahrenheit, is more specifically between 290 and 310 degrees Fahrenheit, and specifically is about 300 degrees Fahrenheit.

In various embodiments, body 12 and membrane 30 may be each formed such that membrane 30 has a rupture stress (i.e., the stress at which the material ruptures) that is less than the rupture stress of body 12. In one such embodiment, body 12 and membrane 30 may be each formed from different materials, such that the rupture stress of membrane 30 is less than the rupture stress of body 12, to provide for differential failure upon squeezing discussed above. For example, in one embodiment, membrane 30 is made from a first type of material and body 12 is made from a second type of material, and the rupture stress of the first type of material is less than the rupture stress of the second type of material. In addition, the rupture stress of membrane 30 is also less than the rupture stress of the heat seals of pouch 10. In another embodiment, membrane 30 and body 12 may be formed from the same type of material (e.g., both are monolayers of the same type of thermoplastic) but with different thicknesses such that membrane 30 has a rupture stress less than the rupture stress of body 12. Further, in various embodiments, the squeeze to dispense operation of pouch 10 may facilitate dispensing without spilling as compared to pouring from standard rigid wall containers or to dispensing from a package without internal membrane 30.

In various embodiments, the rupture stress of membrane 30 is selected to be rupturable by application of manual force. In such embodiments, the rupture stress of membrane 30 is between 0.5 psi and 80, specifically is between 2 psi and 30 psi, and more specifically is between 5 psi and 15 psi. In one specific embodiment, the rupture stress of membrane 30 is about 8 psi. In various embodiments, membrane 30 having rupture stresses discussed in this paragraph is formed from a polymeric material, as discussed above, and in one embodiment, is polyethylene. In such embodiments, the rupture stress of body 12 may be greater than 100 psi, may be greater than 150 psi and may be greater than 200 psi.

In other embodiments, pouch 10 is designed such that membrane 30 is ruptured by application of force by a device, machine or vice, and in such embodiments, the rupture stress of membrane 30 may be greater than a rupture stress that can be ruptured by application of manual force. In such embodiments, pouch 10 may be configured to hold various contents (e.g., chemicals, cleaning agents, lubricants, motor oil, etc.) that are typically used in conjunction with a machine or device such that rupture of membrane 30 within the machine or device is desirable to dispense the contents into the device for use. For example, in one embodiment, pouch 10 is configured to be ruptured within the mop wringer of a mop bucket. In such embodiments, the rupture stress of membrane 30 is greater than 80 psi, and specifically is greater than 120 psi.

In various embodiments, membrane 30 is formed from a material having a thickness between 0.5 mil and 2.5 mil, specifically between 0.5 mil and 1.5 mil, and more specifically between 0.5 mil and 1.0 mil. In one specific embodiment, membrane 30 is formed from a material having a thickness of about 0.75 mil. In one specific embodiment, membrane 30 is formed from a material having a thickness of about 0.75 mil having a rupture stress of about 8 psi. In various embodiments, membrane 30 having thickness discussed in this paragraph is formed from a polymeric material, as discussed above, and in one embodiment, is polyethylene.

Figure 8A:
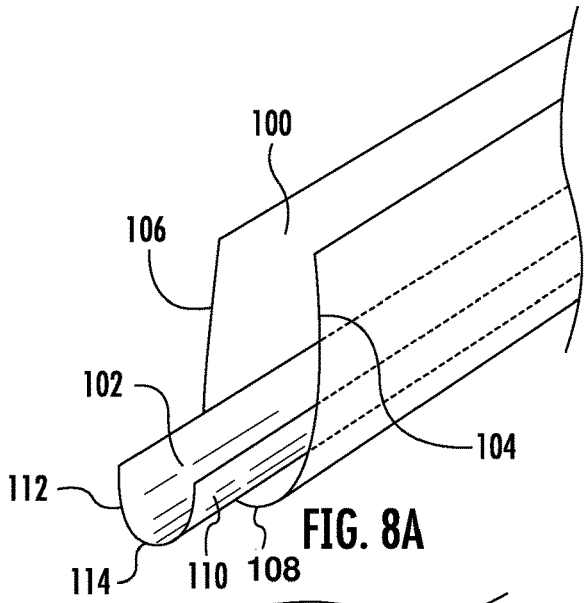
FIGS. 8A-8F show formation of a dispensing pouch according to an exemplary embodiment.

Referring to FIGS. 8A-8F, manufacture of pouch 10 is shown according to an exemplary embodiment. As shown in FIG. 8A, a first sheet of material 100 is provided from which outer container body 12 is made, and a second sheet of material 102 is provided from which membrane 30 is made. Sheet 100 is folded into a substantially U-shaped configuration such that sheet 100 has a front portion 104, a rear portion 106 and a folded edge 108 that provides the folded transition from front portion 104 to rear portion 106. As shown in FIG. 8A, a section of front portion 104 becomes front wall 14 of pouch 10, a section of rear portion 106 becomes rear wall 16 of pouch 10, and a section of folded edge 108 becomes folded edge 28 of pouch 10.

Sheet 102 is also folded into a substantially U-shaped configuration such that sheet 102 has a front portion 110, a rear portion 112 and a folded edge 114 that provides the folded transition from front portion 110 to rear portion 112. As shown in FIG. 8A, a section of front portion 110 becomes front wall 62 of membrane 30 and a section of rear portion 112 becomes rear wall 64 of membrane 30. Sheet 102 is positioned between front portion 104 and rear portion 106, as shown in FIG. 8A, such that the inner surfaces of front portion 104 and rear portion 106 of the outer sheet 100 face the outer surfaces of front portion 110 and rear portion 112 of inner membrane material sheet 102.

Figure 8B:
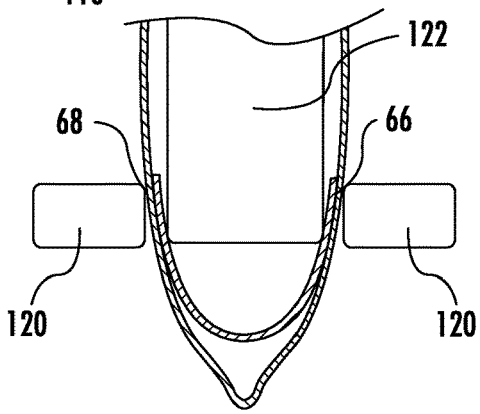

Referring to FIG. 8B, formation of heat seals attach membrane material sheet 102 to the inner surfaces of body material sheet 100 is shown according to an exemplary embodiment. In the embodiment shown, the heat seals coupling membrane material sheet 102 to the inner surface of body material sheet 100 (e.g., heat seals 66 and 68) are formed by heat bars 120. Heat bars 120 are heated to the desired melt or weld temperature and contact the outer surface of body material sheet 100 such that the inner adhesive layer 80 (shown in FIG. 6) melts and bonds to the outer surface of membrane material sheet 102 forming heat seals 66 and 68. An inner supporting member 122 may be used to support material sheets 100 and 102 as heat bars 120 press inward during formation of the heat seals.

Figure 8C:
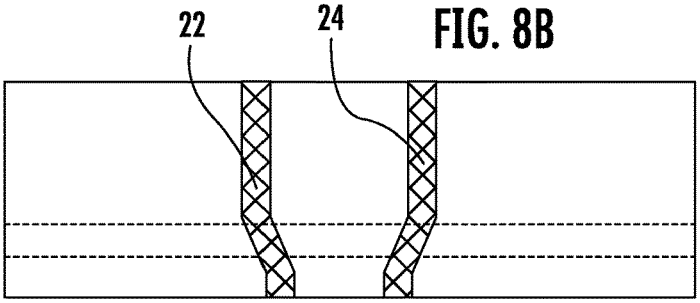
Figure 8D:
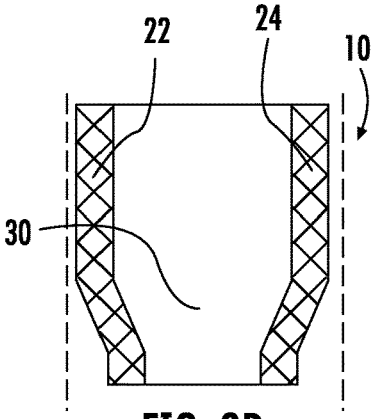
Figure 8E:
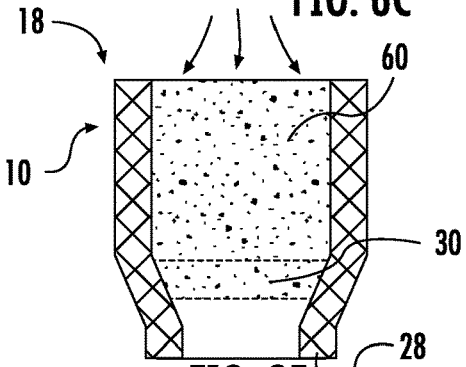
Figure 8F:
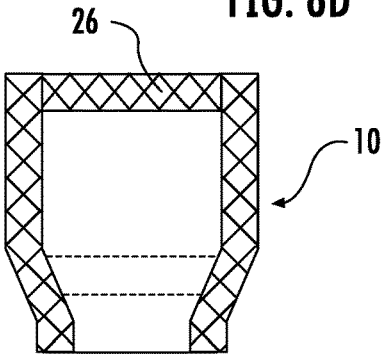

As shown in FIG. 8C, following attachment of membrane 30 to the inner surface of outer material sheet 100, lateral heat seals 22 and 24 are formed. Lateral heat seals 22 and 24 may be formed by contact of heat bars, similar to heat bars 120, vertically to define the lateral edges of pouch 10. As shown in FIG. 8D, material sheets 100 and 102 are cut to the left of left lateral heat seal 22 and to the right of right lateral heat seal 24. This cutting separates pouch 10 from material sheets 100 and 102. As shown in FIG. 8E, upper end 18 of pouch 10 is initially an open filing end allowing container contents 60 to be filled through the open filing end. As shown in FIG. 8F, following filing of pouch 10, upper end 18 is sealed by upper heat seal 26. In various embodiments, the steps shown in FIGS. 8A-8F occur in the order shown. In some embodiments, the process shown in FIGS. 8A-8F repeats sequentially, at different positions along material sheets 100 and 102, such that multiple pouches 10 are formed from sheets 100 and 102. In one embodiment, various heat seal and filling equipment may be configured to create pouch 10 as shown in FIGS. 8A-8F.

Figure 9A:
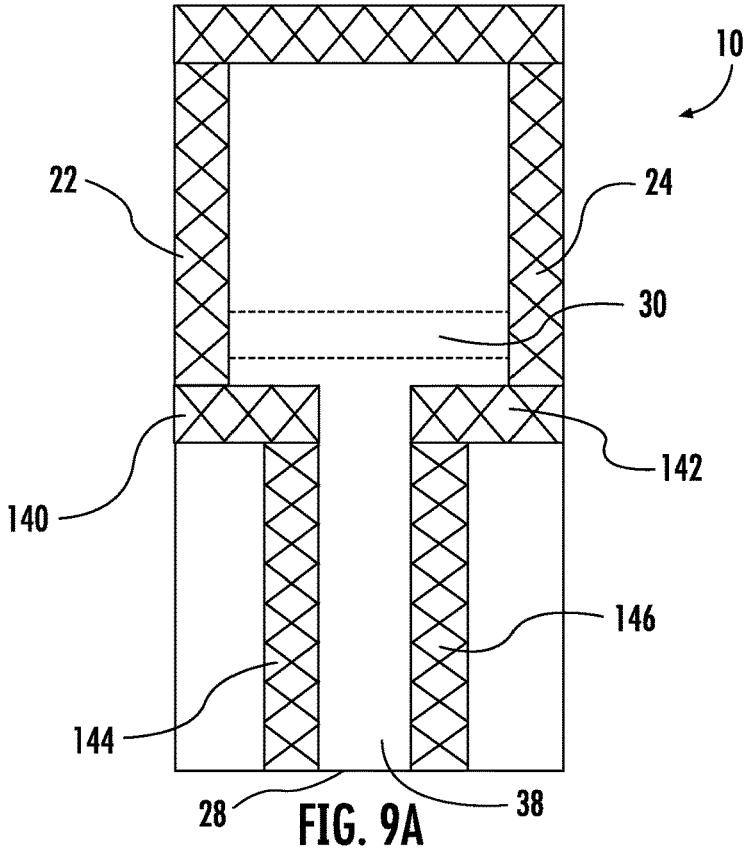
FIGS. 9A and 9B show formation of a dispensing pouch including an extended spout according to an exemplary embodiment.
Figure 9B:
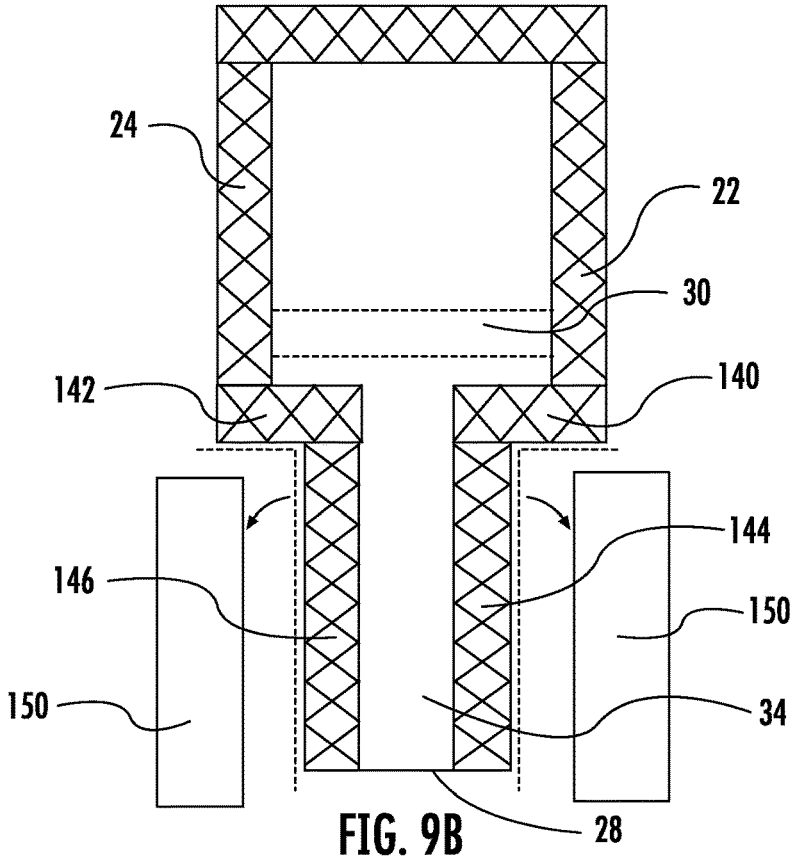

Referring to FIG. 9A and FIG. 9B, formation of pouch 10 including elongated spout 38 is shown according to an exemplary embodiment. As shown in FIG. 9A, the lateral heat seals include first and second horizontal heat seals 140 and 142 that extend inward from lateral heat seals 22 and 24, respectively. First and second spout heat seals 144 and 146 extend along the lateral edges of spout 38 downward away from the inner portions of first and second horizontal heat seals 140 and 142, respectively. As shown, first and second spout heat seals 144 and 146 extend the length of spout 38 from first and second horizontal heat seals 140 and 142 to folded edge 28. As shown in FIG. 9B, following formation of first and second spout heat seals 144 and 146, excess portions 150 of the material of sheet 100 are cut from pouch 10 to create elongated spout 38 that is narrower than the contents containing portion of pouch 10.

The Figures illustrate the exemplary embodiments in detail, and it should be understood that the present application is not limited to the details or methodology set forth in the description or illustrated in the figures. It should also be understood that the terminology is for the purpose of description only and should not be regarded as limiting. Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings of the subject matter described herein. Other substitutions, modifications, changes and omissions may also be made in the design, operating conditions and arrangement of the various exemplary embodiments without departing from the scope of the present invention. While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A heat-sealed squeezable dispensing pouch comprising:

an outer sheet having a front wall, a rear wall and a folded edge located between the front wall and the rear wall, wherein the outer sheet is folded along the folded edge such that an inner surface of the front wall faces an inner surface of the rear wall;

a first heat seal coupling the inner surface of a peripheral section of the front wall to a peripheral section of the inner surface of the rear wall such that the inner surfaces of the front and rear walls define an interior chamber;

a rupturable inner membrane formed from a first material, the rupturable inner membrane located within the interior chamber, wherein the rupturable inner membrane divides the interior chamber into a contents compartment and a dispensing channel, wherein the first heat seal defines an edge of the contents compartment and the folded edge defines an edge of the dispensing channel; and a second heat seal coupling the rupturable inner membrane to the outer sheet;

wherein the second heat seal is positioned in contact with an interior of the contents compartment;

wherein the rupturable inner membrane is configured to break when a pressure within the contents compartment is greater than a rupture threshold, wherein the first and second heat seals are configured to remain sealed when the inner membrane breaks.

2. The dispensing pouch of claim 1 wherein the outer sheet is made from a second material different from the first material of the rupturable inner membrane, wherein the rupture threshold of the first material of the rupturable inner membrane is less than a rupture threshold of the second material.

3. The dispensing pouch of claim 1 wherein the outer sheet is made from a multilayer supported film material.

4. The dispensing pouch of claim 3 wherein the multilayer supported film material includes a foil layer.

5. The dispensing pouch of claim 3 wherein an inner layer of the multilayer supported film material is formed from a heat triggered adhesive material.

6. The dispensing pouch of claim 5 wherein the heat triggered adhesive material is configured to attach to the first material of the rupturable inner membrane.

7. The dispensing pouch of claim 1 further comprising an extended spout extending away from the rupturable inner membrane to the folded edge, wherein the dispensing channel is located within the extended spout, wherein an axial length of the extended spout between the rupturable inner membrane and the folded edged is greater than 30 percent of a total axial length of the dispensing pouch.

8. The dispensing pouch of claim 1 further comprising container contents located in the contents compartment, wherein the rupturable inner membrane, the first heat seal and the second heat seal are fluid tight such that the container contents are maintained in the contents compartment prior to rupture of the rupturable inner membrane, wherein uppermost edges and lowermost edges of the second heat seal is located within the contents compartment such that the container contents contact inner surfaces of the second heat seal, wherein an upper edge of the rupturable inner membrane is located within the contents compartment such that the container contents contact the upper edge of the rupturable inner membrane.

9. The dispensing pouch of claim 1 wherein the front wall and the rear wall of the outer sheet each include an upper edge that together define a filling opening, wherein an uppermost surface of the membrane is located between the folded edge and the upper edges of both the front and rear wall, wherein the outer sheet includes a left edge extending from the folded edge to the filling opening and a right edge extending from the folded edge to the filling opening, wherein the rupturable inner membrane extends across the contents compartment such that a left edge of the rupturable inner membrane aligns with the left edge of the outer sheet and a right edge of the rupturable inner membrane aligns with the right edge of the outer sheet.

10. The dispensing pouch of claim 1 wherein the contents compartment is defined by both a surface of the membrane and by portions of the inner surfaces of the front and rear walls of the outer sheet, such that, when filled, container contents within the contents compartment contact both the surface of the membrane and the inner surfaces of the front and rear walls of the outer sheet.

11. A fluid dispensing container comprising:

a container body formed from a first flexible material, the container body having an outer surface, an inner surface, a filling end and a dispensing end, the inner surface of the container body defining an interior cavity;

a top heat seal sealing the filling end of the container body;

a membrane formed from a second flexible material; and a membrane seal coupling the membrane to the inner surface of the container body at a position located between the filling end and the dispensing end such that the membrane divides the interior cavity into a contents chamber and a dispensing chamber, wherein a first surface of the membrane faces the dispensing chamber and an opposing second surface of the membrane faces the contents chamber and the top heat seal, wherein the entire membrane seal is located within the contents chamber, wherein the membrane and the membrane seal are configured to be fluid tight to maintain fluid within the contents chamber prior to rupture of the membrane, wherein the membrane seal is separate from the top heat seal;

wherein a rupture threshold of the second flexible material is less than a rupture threshold of the first flexible material such that, as fluid pressure within the contents chamber increases, the membrane is configured to rupture without the container body rupturing.

12. The fluid dispensing container of claim 11 wherein the container body is formed from a single sheet of material folded such that the container body includes a first sidewall portion, a second sidewall portion, a left lateral edge extending from the dispensing end to the filling end and a right lateral edge extending from the dispensing end to the filling end, wherein the membrane extends across the interior cavity such that a left edge of the membrane aligns with the left lateral edge of the container body and a right edge of the membrane aligns with the right lateral edge of the container body;

wherein the membrane is formed from a contiguous, single monolayer of thermoplastic material.

13. The fluid dispensing container of claim 12 further comprising:

a left lateral heat seal sealing the left lateral edge of the container body and sealing the left edge of the membrane to the container body; and a right lateral heat seal sealing the right lateral edge of the container body and sealing the right edge of the membrane to the container body;

wherein the single sheet of material is folded to create a folded edge located opposite the top heat seal, and the folded edge is located at the dispensing end of the container body.

14. The fluid dispensing container of claim 13 wherein the membrane is located closer to the folded edge than to the top heat seal.

15. The fluid dispensing container of claim 14 further comprising a frangible score located adjacent to the folded edge and configured to facilitate removal of the folded edge to create an opening in the dispensing end.

16. The fluid dispensing container of claim 11 wherein the rupture threshold of the first material is greater than 100 psi, and the rupture threshold of the second material is between 2 psi and 30 psi, and further comprising a fluid located within the contents chamber, wherein the fluid within the contents chamber is in contact with second surface of the membrane and in contact with an inner surface of the membrane seal.

17. The fluid dispensing container of claim 11 wherein the contents chamber is defined by both the second surface of the membrane and by at least a portion of the inner surface of the container body, such that, when filled, container contents within the contents chamber contact both the second surface of the membrane and the portion of the inner surface of the container body.

18. A container comprising:

a container body formed from a first flexible material, the container body having an outer surface, an inner surface, a dispensing end, and an upper edge defining a filling opening, the inner surface of the container body defining an interior cavity;

a membrane formed from a second flexible material; and a seal coupling the membrane to the inner surface of the container body at a position located between the filling opening and the dispensing end such that the membrane divides the interior cavity into a contents chamber and a dispensing chamber, wherein an uppermost surface of the membrane is located below the upper edge of the container body and above the dispensing end;

wherein the seal is located within the contents chamber;

wherein a rupture threshold of the second flexible material is less than a rupture threshold of the first flexible material;

wherein a width of the container body at the dispensing end is less than a width of the container body at the location of the seal coupling the membrane to the inner surface of the container body.

19. The container of claim 18 wherein the rupture threshold of the first material is greater than 100 psi, and the rupture threshold of the second material is between 2 psi and 30 psi.

20. The container of claim 18 comprising:

a left lateral heat seal sealing a left lateral edge of the container body;

a right lateral heat seal sealing a right lateral edge of the container body; and a top heat seal sealing the filling opening of the container body;

wherein the container body is formed from a single sheet of material folded such that the container body includes a folded edge located opposite the top heat seal, and the folded edge is located at the dispensing end of the container body;

wherein the membrane is located closer to the folded edge than to the top heat seal;

wherein a frangible score is located between the folded edge and the membrane;

wherein the membrane is U-shaped in cross-section including a front wall, a rear wall and a curved section joining the front wall to the rear wall, wherein a lower, convex surface of the curved section faces the dispensing end and an upper, concave surface of the curved section faces the contents chamber.

* * * * *